US007478491B2

(12) United States Patent
Sturba et al.

(10) Patent No.: US 7,478,491 B2
(45) Date of Patent: Jan. 20, 2009

(54) APPARATUS AND METHOD FOR PRINTING IMAGES WITH INTEGRAL FRAME

(76) Inventors: Michael A. Sturba, 1911 Francois Road, Windsor, Ontario (CA) N8W 4S9; Russell N. Wilson, 1858 Labadie, Windsor, Ontario (CA) N8W 4J7

( * ) Notice: Subject to any disclaimer, the term of this patent is extended or adjusted under 35 U.S.C. 154(b) by 243 days.

(21) Appl. No.: 10/953,826

(22) Filed: Sep. 29, 2004

(65) Prior Publication Data

US 2006/0064907 A1 Mar. 30, 2006

(51) Int. Cl.
*G09F 1/00* (2006.01)

(52) U.S. Cl. ..... 40/124.16; 40/124.19; 40/788

(58) Field of Classification Search ..... 40/124.17, 40/124.18, 124.19, 786, 788, 539, 124.16, 40/754; 229/92.8; 248/459
See application file for complete search history.

(56) References Cited

U.S. PATENT DOCUMENTS 2,472,166 A * 6/1949 Mathewson ..... 40/124.16
2,783,013 A * 2/1957 Williamson ..... 248/450
3,013,668 A * 12/1961 Mennen ..... 211/40
4,143,847 A * 3/1979 Cross ..... 248/459
4,309,835 A * 1/1982 Naeve ..... 40/310
4,735,356 A * 4/1988 Engel ..... 229/103
4,885,854 A * 12/1989 Brandes ..... 40/750
D343,065 S 1/1994 Barbieri
5,277,388 A * 1/1994 Denaro ..... 248/152
5,361,521 A * 11/1994 Burtch ..... 40/750
5,365,684 A * 11/1994 Cartmell ..... 40/788
5,513,455 A * 5/1996 Walker ..... 40/788
5,678,339 A * 10/1997 Marventano ..... 40/789
5,746,689 A * 5/1998 Murphy ..... 493/397
5,822,897 A * 10/1998 Ertzan ..... 40/124.09
D401,767 S 12/1998 Leung
D401,768 S 12/1998 Leung
5,860,904 A * 1/1999 Petkovsek ..... 493/183
D407,809 S 4/1999 Hammond
5,936,862 A 8/1999 Wong
5,950,341 A * 9/1999 Cross ..... 40/750
6,035,565 A * 3/2000 Capehart ..... 40/121
6,059,101 A * 5/2000 Gambardella et al. .... 206/308.1
D431,911 S 10/2000 Napracone
D437,493 S 2/2001 Napracone
D440,052 S 4/2001 Napracone
6,248,426 B1 * 6/2001 Olson et al. ..... 428/195.1
D451,686 S 12/2001 Allen
D452,081 S 12/2001 Rowan
D457,734 S 5/2002 Chan
6,427,371 B2 8/2002 Olson et al.
D464,050 S 10/2002 Mori
D468,912 S 1/2003 Guay (Continued)

*Primary Examiner*—William L. Miller
(74) *Attorney, Agent, or Firm*—Fraser Clemens Martin & Miller LLC; William J. Clemens

(57) ABSTRACT

A display apparatus is formed from sheet of stock having an image portion separable from a support portion wherein an image is printed on a display side of the image portion and the two portions assembled together to form an integral frame free-standing display. The sheet is provided with die cut and score lines so that no cutting or pasting is required. A computer program enables the combination of digital photographs, simulated picture frame images, clip art and text for processing through a personal computer printer.

15 Claims, 5 Drawing Sheets

U.S. PATENT DOCUMENTS 6,510,637 B2 * 1/2003 DeLozada et al. ..... 40/788
6,539,653 B1 4/2003 Finke
6,581,895 B1 * 6/2003 Pleasant ..... 248/459
6,584,717 B2 7/2003 Cinquina
6,612,061 B2 * 9/2003 Janetzke ..... 40/789
D483,957 S 12/2003 Skinner
6,672,624 B2 * 1/2004 Fabel ..... 283/116
6,679,032 B2 1/2004 Gerrie
6,694,657 B2 2/2004 Tsao
6,718,676 B2 4/2004 Miska
D491,733 S 6/2004 Manrique
7,275,678 B2 * 10/2007 Hodsdon et al. ..... 229/92.8
2002/0081446 A1 * 6/2002 Boudouris et al. ..... 428/469
2004/0099541 A1 * 5/2004 Sturba et al. ..... 206/39

* cited by examiner

APPARATUS AND METHOD FOR PRINTING IMAGES WITH INTEGRAL FRAME

BACKGROUND OF THE INVENTION

The present invention relates generally to printable paper products and methods for producing them and, in particular, to an apparatus and method for printing images integral with a frame.

The availability of low-cost, high-quality digital cameras has enabled users of these cameras easy and quick access to the images captured by the cameras. The availability of low-cost, high-quality color printers has enabled users of digital cameras to print photographic-quality images directly from a personal printer.

While printing the images captured by the digital cameras has been made easier, it remains desirable to provide a frame for mounting and displaying the images once printed or for presenting the images as a gift or the like. Conventional picture frames, however, can be both heavy and expensive.

There is shown in the U.S. Pat. No. 4,885,854 a picture frame formed of a unitary blank formed in three sections that may be folded to form the picture frame. The frame includes an aperture formed in one of the sections for displaying a separate photograph.

There is shown in the U.S. Pat. No. 5,936,862 a computer program for generating picture frames from a single sheet of paper along with a pattern with fold and cut lines to create the picture frame. The frame includes a window that the user may remove, or may choose to place art, an imported picture, or design patterns on the window. The frame is assembled by cutting and pasting various portions of the frame and/or picture.

There is shown in the U.S. Pat. No. 6,612,061 a foldable picture frame that permits direct printing of a picture and a border. The specification recites that a first side of a flat sheet is utilized to print a digital photograph or picture and is then turned over to print graphics on the other side of the sheet. In addition, a center panel is then removed in order to form a viewing window for the picture.

It is desirable, therefore, to provide a picture frame with a picture display area formed from a single sheet of stock that does not require removal of a window and can be printed in a single pass.

SUMMARY OF THE INVENTION

The present invention concerns a sheet of stock for use in printing images with an integral frame and a computer program for printing an image on the sheet. In one embodiment, an image portion and a support portion are separated, the support portion folded and the two portions attached to stand upright on a surface. In another embodiment, the sheet of stock has magnetic properties that permit attachment to a metal surface such as a refrigerator door.

A display apparatus for use in printing images with an integral frame includes an image portion having a display side and an opposite side, the image portion having first attachment means formed integral therewith, and a support portion attached to the image portion to form the sheet of stock, the support portion being attached to the image portion at a separation die cut line formed in the sheet of stock, the support portion having second attachment means formed integral therewith, whereby when the support portion is separated from the image portion at the separation die cut line and the first and second attachment means are engaged, the image portion and the support portion cooperate with a generally horizontal support surface to orient the display side in a generally vertical plane for viewing. The first attachment means can be a pair of frame extensions extending along opposite edges of the image portion and separated from an image area by a pair of attachment die cut lines while the second attachment means can be a pair of tabs extending from the support portion for engaging associated openings formed by the attachment die cut lines.

The display apparatus includes a plurality of score lines formed in the support portion for folding the support portion into a generally V-shape after separation from the image portion. The sheet of stock can include a carrier portion detachably attached to the image portion and the support portion during printing of at least one image on the image portion, the carrier portion being separated from the image portion and the support portion prior to engagement of the first and second attachment means. The image portion includes an image area bounded by a pair of frame extensions, each frame extension being separated from the image area by an attachment die cut line extending between a pair of score lines.

In an alternate embodiment, the display apparatus includes a sheet of stock having a display side with at least one image portion and a support side opposite the display side, and magnetic means being one of integral with the sheet of stock and a layer attached to the support side, whereby when the image is printed on the at least one image portion, the magnetic means is operable to retain the sheet of stock on a metal surface with the display side oriented for viewing the image. The image portion can have a representation of a picture frame printed thereon and can be surrounded by a carrier portion of the sheet of stock and including die cut lines formed in the sheet of stock for separating the carrier portion from the image portion. The sheet of stock is sized for use with a personal computer printer.

The present invention includes a method for forming an image display apparatus having an integral frame, comprising the steps of: providing a sheet of stock having an image portion separable from a support portion, the sheet of stock having a display side; obtaining an image in digital form; printing the image on the display side in an image area of the image portion; separating the support portion from the image portion; and assembling the support portion to the image portion to form a framed image display apparatus that cooperates with a generally horizontal support surface to orient the display side of the image portion in a generally vertical plane for viewing. The image can include a frame image representing a simulated picture frame and a photo image wherein the frame image is selected from a stored plurality of different frame images.

The method can include a step of obtaining a clip art image and printing the clip art image on the display side at a selected location in the image portion. The method includes forming a die cut line in the sheet of stock between the image portion and the support portion and separating the support portion from the image portion at the die cut line. The method can include a step of generating text and printing the text on the display side at a selected location in the image portion.

The assembled frame fits into a standard greeting card size envelope, which advantageously allows the frame to be mailed with any brand-name greeting card or separately utilizing provided envelopes. The present invention may advantageously include inserts for any occasion, including Christmas, birthday, retirement, and thank you inserts.

The sheet of stock in accordance with the present invention advantageously provides a picture frame that is portable and inexpensive to produce.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
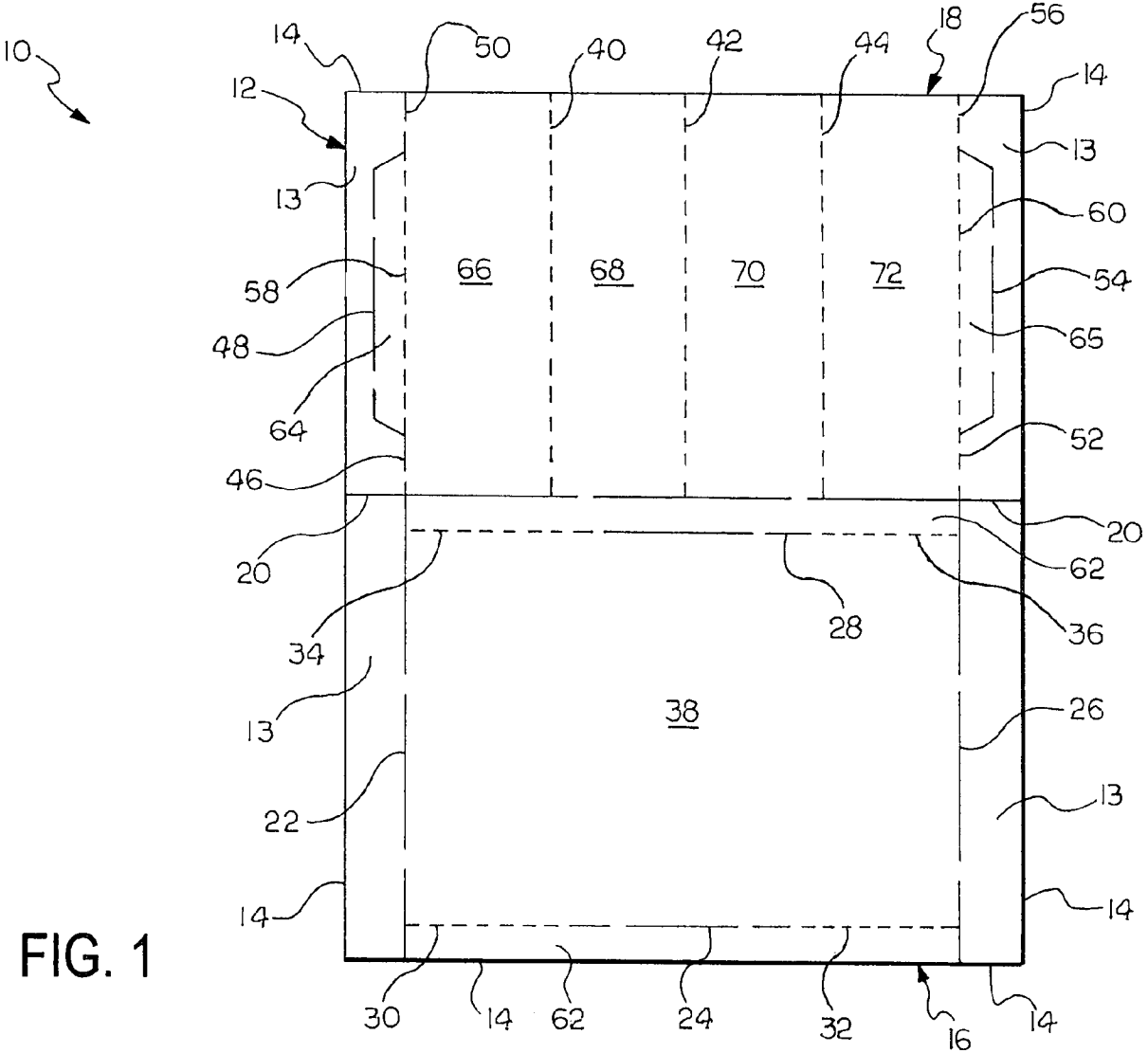
FIG. 1 is a schematic view of a sheet of stock for a frame in accordance with the present invention.
Figure 4B:
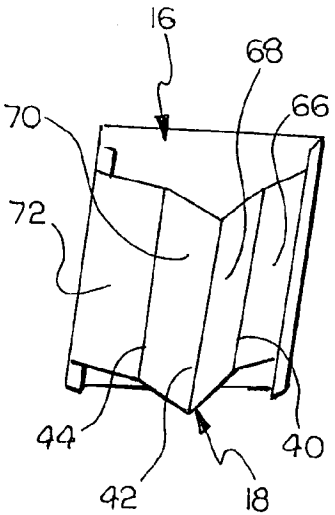
FIGS. 4*a* and 4*b* are rear elevation views in landscape and portrait orientations, respectively, of the frame of FIG. 2*a* and 2*b;*
Figure 4A:
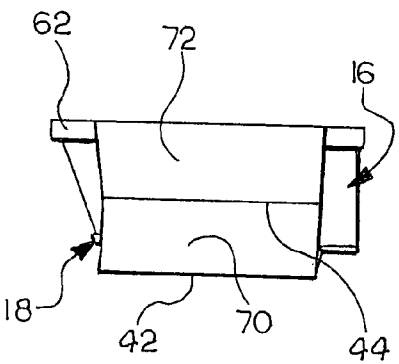
Figure 2B:
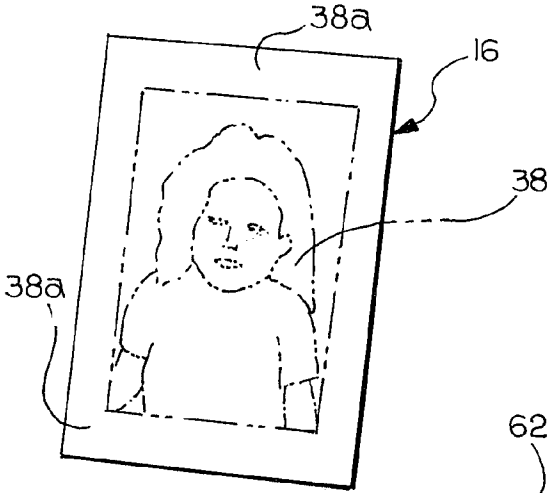
FIGS. 2*a* and 2*b* are front elevation views in landscape and portrait orientations, respectively, of the frame of FIG. 1.
Figure 3B:
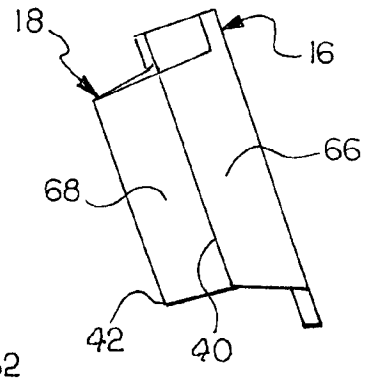
FIGS. 3*a* and 3*b* are side elevation views in landscape and portrait orientations, respectively, of the frame of FIGS. 2*a* and 2*b;*
Figure 2A:
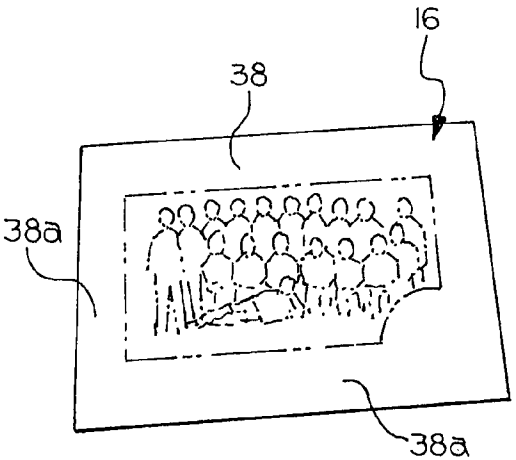
Figure 3A:
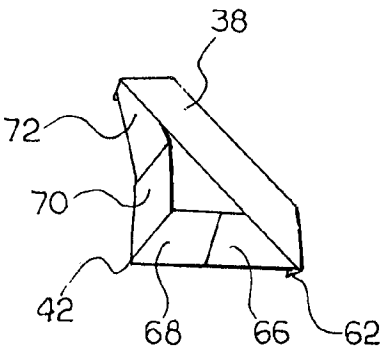

Referring now to FIG. 1, a sheet of stock 12 for forming a frame 10 in accordance with the present invention is shown. The sheet 12 is defined by a peripheral edge 14 thereof. Preferably, the sheet 12 is sized to a standard paper sheet size, such as 8½ inch by 11 inch paper, 8½ inch by 14 inch paper, A4 paper, and the like, and that can be used with a suitable printer (not shown), such as a commercially available black and white printer or a color printer. For example, the sheet 12 in a single sheet form is particularly suited to the type of commercially available printer used with personal computers in homes and businesses. Alternatively, the sheet 12 can be sized to reduce the amount of waste material at the edge 14. The sheet 12 may also be provided in continuous feed form for high speed volume printing.

As shown in FIG. 1, the frame 10 is aligned with the sheet of stock 12 in the "portrait" orientation well known to users of computer printers. Those skilled in the art, however, will appreciate that the frame 10 may be formed in a "landscape" orientation also well known to users of computer printers and/or oriented and/or sized to allow for multiple frames 10 to be formed from a single sheet of stock 12.

The frame 10 is formed by a plurality of die cut and score lines. In FIG. 1, relatively long lines interrupted by short breaks, such as a line 20, represent die cut lines with the solid long lines being cuts extending through the stock 10 and the breaks being uncut stock that easily tears when the frame 10 is removed from the sheet 12. Dashed lines, such as a line 30, represent score lines which are continuous cuts that do not extend completely through the sheet 12 and serve to facilitate folding of the frame 10 after the frame 10 has been removed from the sheet 12, discussed in more detail below.

The frame 10 is formed by a plurality of die cut and score lines and includes an image portion 16 and a support portion 18. The image portion 16 and the support portion 18 are separated by the die cut line 20 extending substantially through the vertical center of the sheet 12. The image portion 16 includes a plurality of die cut lines 22, 24, and 26 adjacent and substantially parallel with respective portions of the edge 14 of the sheet 12 and another die cut line 28 adjacent and substantially parallel to the cut line 20. The image portion 16 also includes the score line 30 extending between the cut lines 22 and 24, a score line 32 extending between the cut lines 24 and 26, a score line 34 extending between the cut lines 22 and 28, and a score line 36 extending between the cut lines 26 and 28. The die cut lines 22, 24, 26, and 28, and the score lines 30, 32, 34, and 36 define an image area 38 therebetween. The image area 38 is a location wherein a digital image may be printed when the sheet 12 is run through a computer printer (not shown), discussed in more detail below.

The support portion 18 includes a plurality of score lines 40, 42, and 44 extending between the cut line 20 and an upper portion of the edge 14. A die cut line 46 extends from the die cut line 20 to a die cut line 48, which extends to another die cut line 50. Similarly, a die cut line 52 extends from the cut line 20 to a die cut line 54, which extends to another die cut line 56. A score line 58 extends between the cut lines 46 and 50 and a score line 60 extends between the cut lines 52 and 56.

The die cut lines 22, 24, 26, 46, 48, 50, 52, 54, and 56 define a periphery of the frame 10 at which the frame 10 can be separated from a surrounding carrier portion 13 of the sheet 12. During manufacture of the frame 10, the die cut lines 20, 22, 24, 26, 46, 48, 50, 52, 54, and 56 are cut and formed by a die (not shown), which provides a complete cut through the sheet of stock 12 at the solid portions but allows the frame 10 to be run through the printer without separating from the sheet 12. The score lines 30, 32, 34, 36, 40, 42, 44, 58, and 60 do not extend completely through the sheet 12 and allow the image portion 16 and a support portion 18 to be folded to form the frame 10.

After the sheet 12 with the frame 10 has been run through the computer printer, the frame 10 may be separated from the carrier portion 13 of the sheet 12 to form the frame 10, best seen in FIGS. 2*a*-4*b*. Alternatively, the frame 10 may be separated from the sheet without running the sheet 12 and the frame 10 through the printer. The sheet 12 is separated from the sheet carrier portion 13 by applying pressure to the sheet 12 adjacent the cut lines 22, 24, 26, 46, 48, 50, 52, 54, and 56 while holding on to the frame 10. Once the frame 10 is separated from the carrier portion 13, the frame 10 can be folded along the score lines 30, 32, 34, 36, 40, 42, 44, 58, discussed in more detail below, to form the frame 10.

The frame 10 is formed by separating the image portion 16 and a support portion 18 from the sheet 12 along the die cut lines 22, 24, 26, 46, 48, 50, 52, 54, and 56. The image portion 16 and a support portion 18 are then separated from each other along the die cut line 20. The die cut lines 24 and 28 are then separated from the image portion 16, while the score lines 30, 32, 34, and 36 allow respective frame portions 62 to remain attached to the image area 38 and fold or flex with respect to the image area 38.

When the support portion 18 is separated from the carrier portion 13, the cut lines 48 and 54 form respective tabs 64 and 65 at opposite ends of the support portion 18. The score lines 58 and 60 allow the respective tabs 64 and 65 to remain attached to the support portion 18 and fold or flex with respect to the support portion 18. The score lines 40, 42, 44, 58, and 60 define a plurality of support sections 66, 68, 70, and 72 of the support portion 18.

To form the frame 10, the support sections 66, 68, 70, and 72 of the support portion 18 are folded along the score lines 40, 42, and 44. The sections 66, 68, 70, and 72 form a substantially V-shape support, best seen in FIGS. 3*a*-4*b*, to engage with a display surface, such as a desk top, table, or the like, and the sections 66 and 72 extend at an angle to the tabs 64 and 65, best seen in FIG. 4*b*. The tabs 64 and 65 are folded along the lines 58 and 60 and inserted into a respective aperture formed in the image portion 16 when the score lines 24 and 28 are separated therefrom to attach the support portion 18 to the image portion 16 and thereby form the frame 10. Either the tab 64 or 65 may be placed in the aperture of the score line 24 or 28, advantageously making the frame 10 easy to assemble. Depending on the orientation of the image printed in the image area 38, the frame 10 may be placed with either of the support sections 68 or 70 engaging the display surface (in a landscape orientation), or with both the sections 66 and 68 or the sections 70 and 72 engaging the display surface in the landscape orientation, best seen in FIG. 3*a*, depending on the desired angle of presentation of the image printed on the image area 38. Alternatively, the frame 10 may be placed with both the support sections 68 and 70 engaging the display surface along the score line 42 (in a portrait orientation), best seen in FIGS. 3*b* and 4*b*. The support portion 18 and the image portion 12 combine to provide a stable display for the frame 10. The assembled frame 10 preferably fits into a standard greeting card size envelope. The frame 10 in accordance with the present invention can advantageously be folded and displayed after a single pass through a personal computer printer without any cutting or pasting.

Figure 5:
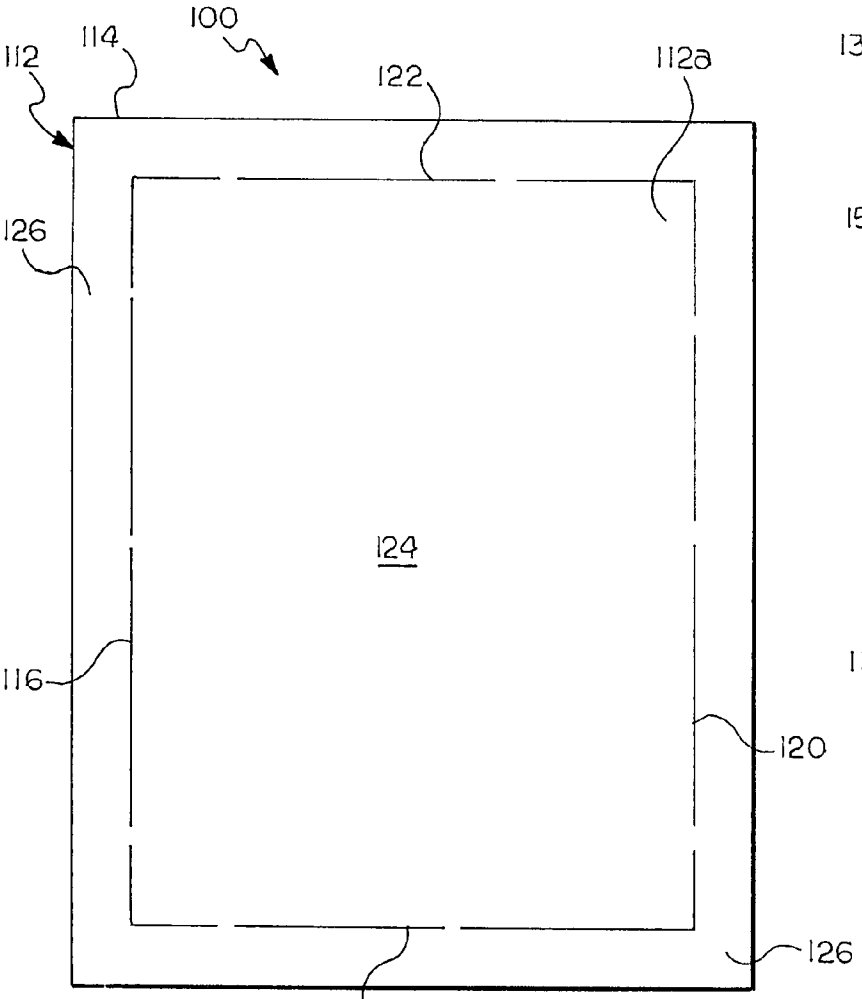
FIG. 5 is a schematic view of a sheet of stock for an alternative embodiment of a frame in accordance with the present invention.

Referring now to FIG. 5, a sheet of stock 112 for forming an alternative embodiment of a frame 100 in accordance with the present invention is shown. The sheet 112 is defined by a peripheral edge 114 thereof. Preferably the sheet 112 is formed of a magnetic paper stock or the like having magnetic materials and/or properties on a surface (not shown) opposite a printing surface, indicated generally at 112*a* in FIG. 5. Preferably, the sheet 112 is sized to a standard paper sheet size, such as 8½ inch by 11 inch paper, 8½ inch by 14 inch paper, A4 paper, and the like, and that can be used with a suitable printer (not shown), such as a commercially available black and white printer or a color printer. For example, the sheet 112 in a single sheet form is particularly suited to the type of commercially available printer used with personal computers in homes and businesses. Alternatively, the sheet 112 can be sized to reduce the amount of waste material at the edge 114. The sheet 112 may also be provided in continuous feed form for high speed volume printing.

The frame 100 includes a plurality of die cut lines 116, 118, 120, and 122 adjacent and substantially parallel with respective portions of the edge 114 of the sheet 112 that define an image area 124 therebetween. The image area 124 is a location wherein a digital image may be printed when the frame 100 and sheet 112 are run through a computer printer (not shown). The die cut lines 116, 118, 120, and 122 define a periphery of the frame 100 at which the frame 100 can be separated from a surrounding carrier portion 126 of the sheet 112. During manufacture of the frame 100, the die cut lines 116, 118, 120, and 122 are cut and formed by a die (not shown), which provides a complete cut through the sheet of stock 112 at the solid portions but allows the frame 100 to be run through the printer without separating from the sheet 112. After being run through the printer, the frame 100 is separated from the carrier portion 126 by applying pressure to the sheet 112 adjacent the cut lines 116, 118, 120, and 122 while holding on to the frame 100. Once the frame 100 is separated from the carrier portion 126, the frame 100 can be attached to a preferably metallic display surface (not shown), such as a refrigerator door outer surface or the like. The surface having magnetic materials and/or properties advantageously allows the frame 100 to be attached to the display surface without the use of a support member.

Figure 6:
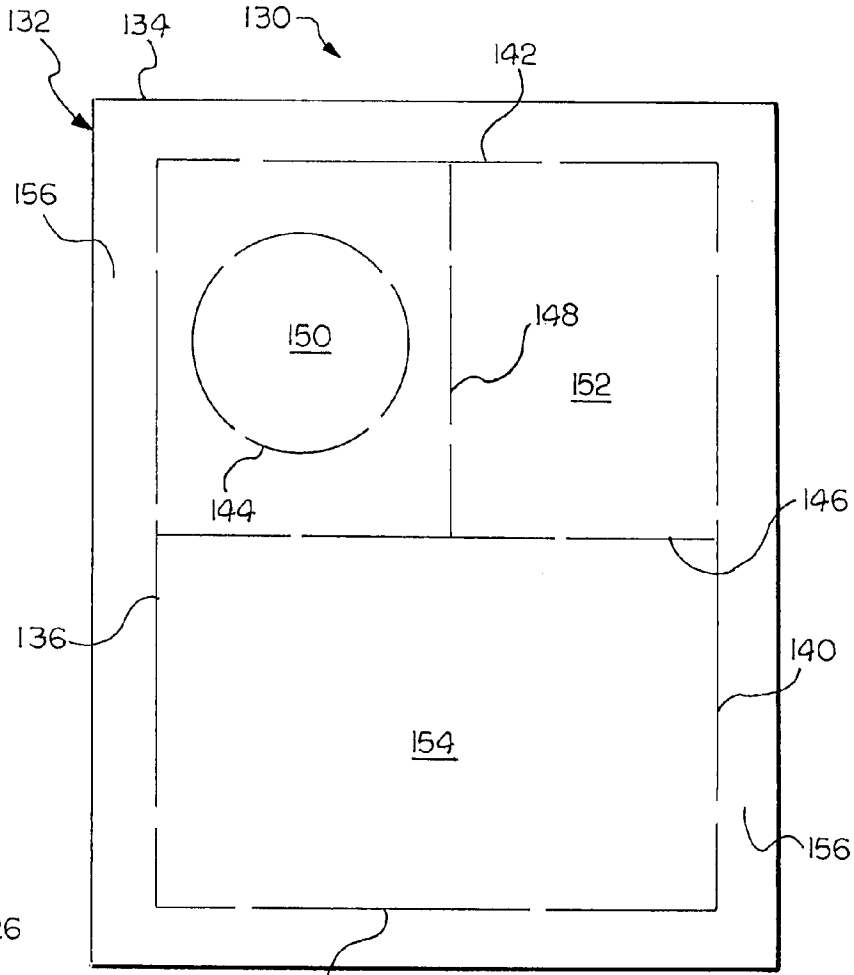
FIG. 6 is a schematic view of a sheet of stock for an alternative embodiment of a frame in accordance with the present invention.

Referring now to FIG. 6, a sheet of stock 132 for forming an alternative embodiment of a frame 130 in accordance with the present invention is shown. The sheet 132 is defined by a peripheral edge 134 thereof. Preferably the sheet 132 is formed of a magnetic paper stock or the like having magnetic materials and/or properties on a surface (not shown) opposite a printing surface, indicated generally at 132*a* in FIG. 5. Preferably, the sheet 132 is sized to a standard paper sheet size, such as 8½ inch by 11 inch paper, 8½ inch by 14 inch paper, A4 paper, and the like, and that can be used with a suitable printer (not shown), such as a commercially available black and white printer or a color printer. For example, the sheet 132 in a single sheet form is particularly suited to the type of commercially available printer used with personal computers in homes and businesses. Alternatively, the sheet 132 can be sized to reduce the amount of waste material at the edge 134. The sheet 132 may also be provided in continuous feed form for high speed volume printing.

The frame 130 includes a plurality of die cut lines 136, 138, 140, and 142 adjacent and substantially parallel with respective portions of the edge 134 of the sheet 132. The frame 130 also includes a substantially oval die cut line 144, and perpendicular die cut lines 146 and 148. The die cut line 144 defines an image area 150. The cut lines 140, 146, and 148 define an image area 152 therebetween and the cut lines 136, 138, 140, and 146 define an image area 154 therebetween. The image areas 150, 152, and 154 are locations wherein a digital image may be printed when the frame 130 and sheet 132 are run through a computer printer (not shown). The die cut lines 136, 138, 140, and 142 define a periphery of the frame 130 at which the frame 130 can be separated from a surrounding carrier portion 156 of the sheet 132. During manufacture of the frame 130, the die cut lines 136, 138, 140, 142, 144, 146, and 148 are cut and formed by a die (not shown), which provides a complete cut through the sheet of stock 132 at the solid portions but allows the frame 130 to be run through the printer without separating from the sheet 132. After being run through the printer, the image portions 150, 152, and 154 of the frame 130 are separated from the carrier portion 156 by applying pressure to the sheet 132 adjacent the cut lines 136, 138, 140, 142, 144, 146, and 148 while holding on to the frame 130. Once the image portions 150, 152, and 154 of the frame 130 are separated from the carrier portion 156, the image portions 150, 152, and 154 of the frame 100 can be attached to a preferably metallic display surface (not shown), such as a refrigerator door outer surface or the like. The surface having magnetic materials and/or properties advantageously allows the frame 130 to be attached to the display surface without the use of a support member. Although one image portion is shown in the frame 100 and three image portions are shown in the frame 130, those skilled in the art will appreciate that any desired number of image portions of any desired shape may be formed from the sheets of stock 112 or 132 while remaining within the scope of the present invention.

Figure 7:
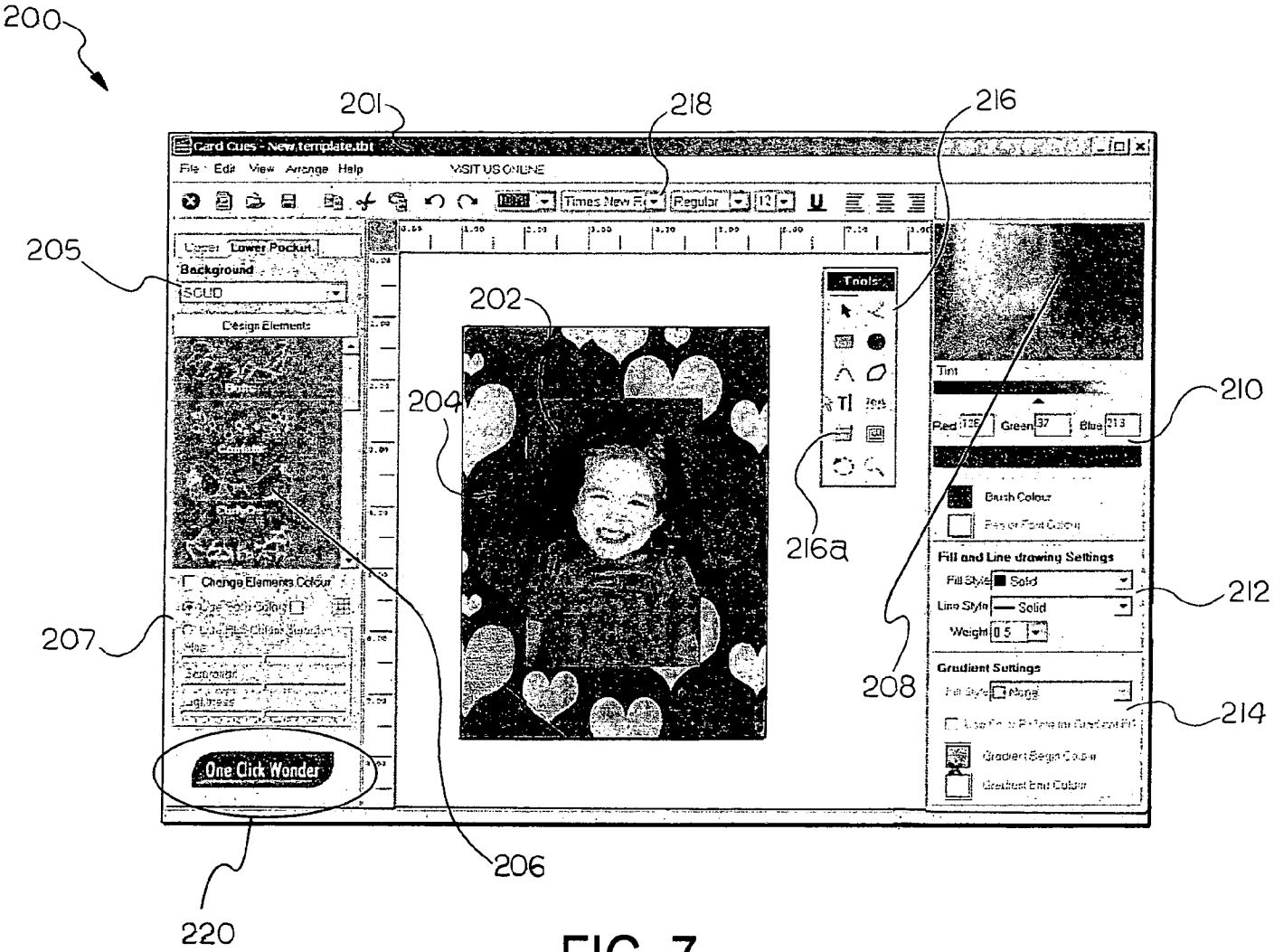
FIG. 7 is a schematic view of a computer screen display generated by a computer program in accordance with the present invention.

Referring now to FIG. 7, there is shown a graphical user interface 201 of a computer program 200 in accordance with the present invention for installation on a personal computer or the like. The computer program 200 includes an imported image 202 to be printed on a layout area 203. The computer program 200 is utilized to edit the image 202 for printing on the image area 38 of the frame 10, the image area 116 of the frame 100, or the image areas 150, 152, and 154 of the frame 130, as well as on a peripheral edge 38*a*, best seen in FIG. 2*b*, of the image area 38 to form an image of a picture frame or the like. The image 202 is edited in the layout area 203 by adding an image 204 for a frame or a matte, which may be selected from a pattern area 206. The pattern area 206 may be edited and/or selected in a background area 205 and a color change area 207. The colors of the images 202 and 204 may be edited by selecting from color palette areas 208 and 210. The image 202 may also be edited by selecting features from a fill area 212 and a gradient setting area 214. A tools menu 216 allows a user of the computer program 200 to add text, such as from a text edit area 218, as well as clip art (such as licensed clip art for sports, holidays, pets, or similar) from an icon 216*a*. A "one click wonder" area 220 allows a user of the computer program 200 to select from a library including a plurality of predetermined image formats for the images 202 and 204. The text or clip art images from tools menu 216 may be layered on top of the images 202 and 204, as will be appreciated by those skilled in the art.

Figure 8:
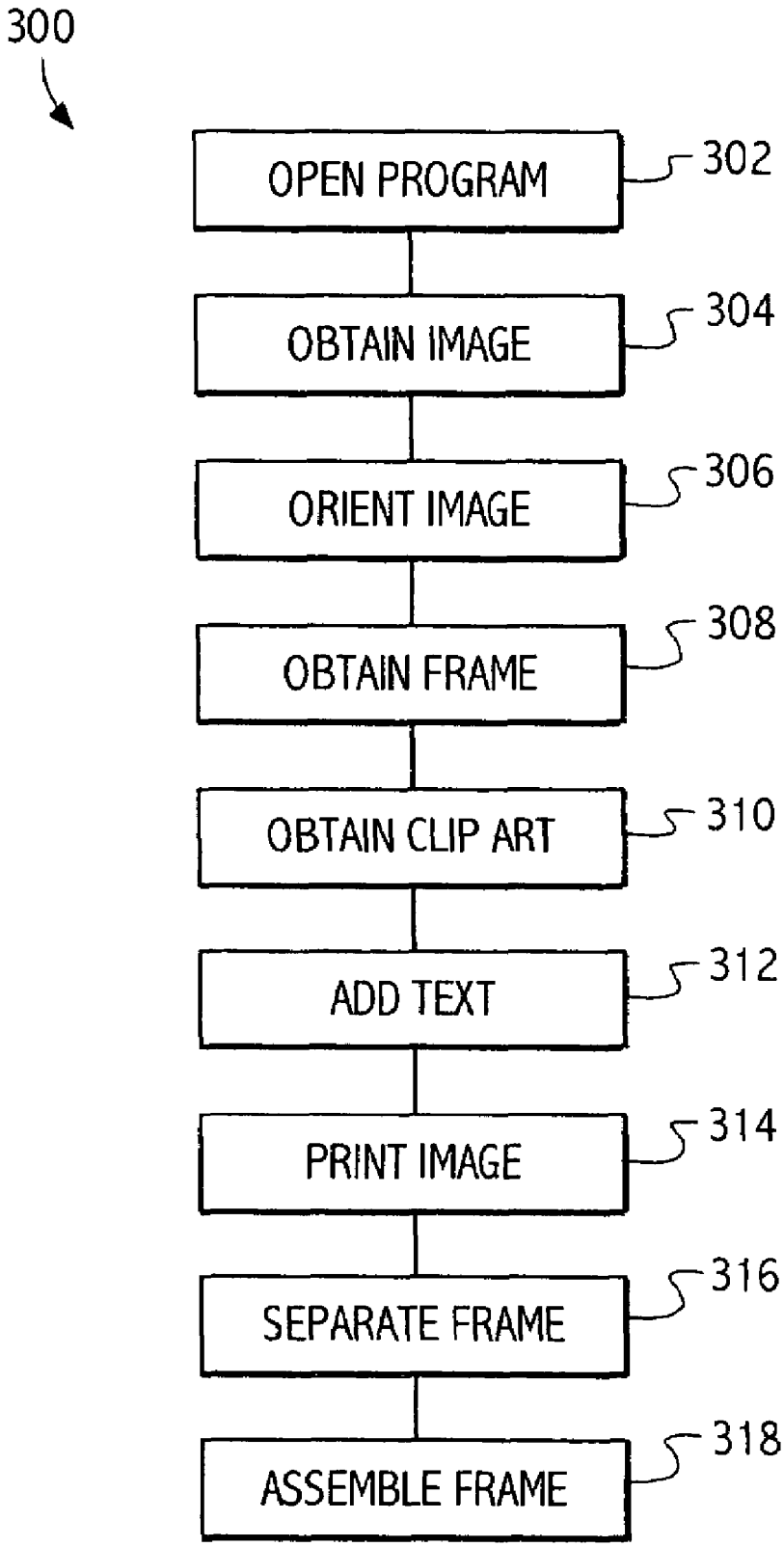
FIG. 8 is a flowchart of a method of operating the computer program.

Referring now to FIG. 8, a method for forming a printed frame, such as the frame 10, 100, or 130 in accordance with the present invention is indicated generally at 300. In a step 302, a user opens the computer program 200 and in a step 304, the user of the computer program 200 obtains an image, such as the image 202, to be printed on the image area 38, 124, 150, 152, or 154, such as from a computer hard drive, a portable storage device, or the like. In a step 306, the user of the computer program 200 orients the image for printing, such as in a portrait orientation, a landscape orientation, or the like. In a step 308, the user of the computer program 200 obtains an image for use as a frame (such as on the edges 38*a*), a matte or the like and adds the frame or matte image to the image 202. The image for the frame may be a digital photograph or the like. In a step 310, the user of the computer program 200 obtains an image for use as clip art, a border, or the like for decorating the image and adds the clip art or border image to the image 202. In a step 312, the user of the computer program 200 enters text to be used in the image area 38, 124, 150, 152, or 154 to create an edited image 202. After the text is entered in the step 312, the edited image 202 is sent in a step 314 to a computer printer (not shown) having a frame 10, 100, or 130 disposed therein. After being printed, the frame 10, 100, or 130 is separated from the respective carrier portions 13, 116, and 136 in a step 316. If the frame utilized in the step 314 is the frame 10, then the frame is assembled in a step 318.

Those skilled in the art will appreciate that the steps shown in the FIG. 8 and outlined above may be changed in order and, if desired, omitted by the user of the computer program 200. For example, if no text was to be added to the printed image 202, the step 312, could be omitted and, similarly, if no frame was to be added to the printed image 202, the step 308 could be omitted while remaining within the scope of the present invention. Furthermore, depending on the type of frame utilized during the step 314, the step 318 is omitted if the frame is the frame 100 or the frame 130 while remaining within the scope of the present invention.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for forming an image display apparatus having an integral frame, comprising the steps of:

a) providing a sheet of stock having an image portion supporting a printed image on said portion and separable from a support portion, the image portion having first attachment means formed integral therewith and including an image area bounded by a pair of frame extensions each separated from the image area by an attachment die cut line extending between a pair of score lines, the support portion being attached to the image portion at a die cut line formed in the sheet of stock, the support portion having a second attachment means formed integral therewith, the sheet of stock having a display side, wherein said sheet of stock is formed from a paper suitable for receiving and retaining printing applied by a printer and having a pair of parallel side edges extending a length of the sheet of stock;

b) obtaining an image in digital form;

c) providing a printer and placing said sheet of stock in the printer;

d) printing the image on the display side in an image area of the image portion of said sheet of stock;

e) separating the support portion from the image portion; and f) assembling the support portion to the image portion by engaging the first and second attachment means and forming a framed image display apparatus having a printed image that cooperates with a generally horizontal support surface to orient the display side of the image portion in a generally vertical plane for viewing, wherein the frame is integrally printed with said image on said image portion of said sheet stock.

2. The method according to claim 1 wherein said step b) is performed by obtaining a frame image representing a simulated picture frame and a photo image and said step c) is performed by printing said photo image surrounded by said frame image.

3. The method according to claim 2 including a step of selecting said frame image from a stored plurality of different frame images.

4. The method according to claim 1 including a step of obtaining a clip art image and performing said step c) by printing the clip art image on the display side at a selected location in the image portion.

5. The method according to claim 1 wherein said step a) includes forming the die cut line in the sheet of stock between the image portion and the support portion and performing said step d) by separating the support portion from the image portion at the die cut line.

6. The method according to claim 1 including a step of generating text and wherein said step c) includes printing the text on the display side at a selected location in the image portion.

7. A display apparatus for use in printing images with an integral frame in combination with a printer, comprising:

a sheet of stock including an image portion and being formed from a paper suitable for receiving and retaining printing applied by a computer printer, said image portion having a display side and an opposite side, and said image portion having first attachment means formed integral therewith wherein said image portion includes an image area bounded by a pair of frame extensions, each said frame extension separated from said image area by an attachment die cut line extending between a pair of score lines;

a printer for receiving said sheet of stock and for applying printing to said display side of said image portion; and said sheet of stock having a pair of parallel side edges extending a length of said sheet of stock for cooperating with said printer and a support portion attached to said image portion at a separation die cut line, formed in said sheet of stock, said support portion having second attachment means formed integral therewith, whereby when said support portion is separated from said image portion at said separation die cut line and said first and second attachment means are engaged, said image portion and said support portion cooperate with a generally horizontal support surface to orient said display side in a generally vertical plane for viewing.

8. The display apparatus according to claim 7 wherein said first attachment means is said pair of frame extensions extending along opposite edges of said image portion and separated from an image area by said attachment die cut lines.

9. The display apparatus according to claim 8 wherein said second attachment means is a pair of tabs extending from said support portion for engaging associated openings formed by said attachment die cut lines.

10. The display apparatus according to claim 7 including a plurality of score lines formed in said support portion for folding said support portion into a generally V-shape after separation from said image portion.

11. The display apparatus according to claim 7 wherein said sheet of stock includes a carrier portion detachably attached to said image portion and said support portion during printing of at least one image on said image portion, said carrier portion being separated from said image portion and said support portion prior to engagement of said first and second attachment means.

12. The display apparatus according to claim 11 wherein said second attachment means is a pair of tabs extending from said support portion into said carrier portion.

13. A display apparatus for use in printing images with an integral frame in combination with a printer, comprising:

a sheet of stock including an image portion and being formed from a paper suitable for receiving and retaining printing applied by a computer printer, said image portion having a display side and an opposite side, and said image portion having first attachment means formed integral therewith;

a printer for receiving said sheet of stock and for applying printing to said display side of said image portion; and said sheet of stock having a pair of parallel side edges extending a length of said sheet of stock for cooperating with said printer and a support portion attached to said image portion at a separation die cut line formed in said sheet of stock, said support portion having second attachment means formed integral therewith, whereby when said support portion is separated from said image portion at said separation die cut line and said first and second attachment means are engaged, said image portion and said support portion cooperate with a generally horizontal support surface to orient said display side in a generally vertical plane for viewing wherein said sheet of stock includes a carrier portion detachably attached to said image portion and said support portion during printing of at least one image on said image portion, said carrier portion being attached at carrier die cut lines formed in said sheet of stock for separation from said image portion and said support portion prior to engagement of said first and second attachment means, and wherein said second attachment means is a pair of tabs extending from said support portion into said carrier portion and terminating at said carrier die cut lines.

14. The display apparatus according to claim 13 wherein said first attachment means is a pair of frame extensions extending along opposite edges of said image portion and separated from an image area by a pair of attachment die cut lines, said tabs being sized to engage associated openings formed by said attachment die cut lines.

15. The display apparatus according to claim 13 including a plurality of score lines formed in said support portion for folding said support portion into a generally V-shape after separation from said carrier portion and said image portion.

* * * * *